United States Patent [19]

Dössel et al.

[11] Patent Number: 4,652,507

[45] Date of Patent: Mar. 24, 1987

[54] ELECTROPHOTOGRAPHIC RECORDING MATERIAL HAVING A PHOTOCONDUCTIVE DOUBLE LAYER AND PROCESS FOR ITS MANUFACTURE

[75] Inventors: Karl-Friedrich Dössel, Wiesbaden; Jürgen Lingnau, Mainz, both of Fed. Rep. of Germany

[73] Assignee: Hoechst Aktiengesellschaft, Frankfurt am Main, Fed. Rep. of Germany

[21] Appl. No.: 640,993

[22] Filed: Aug. 14, 1984

[30] Foreign Application Priority Data

Aug. 16, 1983 [DE] Fed. Rep. of Germany ..... 3329442

[51] Int. Cl.[4] ..... G03G 5/14

[52] U.S. Cl. ..... 430/57; 430/58; 430/132; 430/66

[58] Field of Search ..... 430/57, 58, 81, 83, 430/133, 129

[56] References Cited

U.S. PATENT DOCUMENTS

| | | | |
|---|---|---|---|
| 3,591,374 | 7/1971 | Seus | 430/83 |
| 3,684,548 | 8/1972 | Contois | 430/61 |
| 4,214,907 | 7/1980 | Nakazawa et al. | 430/83 |
| 4,226,928 | 10/1980 | Nakazawa et al. | 430/57 |
| 4,499,167 | 2/1985 | Sano et al. | 430/83 |

FOREIGN PATENT DOCUMENTS

| | | |
|---|---|---|
| 2237539 | 2/1974 | Fed. Rep. of Germany . |
| 3026653 | 1/1981 | Fed. Rep. of Germany . |
| 3108618 | 1/1982 | Fed. Rep. of Germany . |
| 3202552 | 8/1982 | Fed. Rep. of Germany . |
| 3110960 | 9/1982 | Fed. Rep. of Germany . |

OTHER PUBLICATIONS

Foreign Search Report.

*Primary Examiner*—John L. Goodrow

*Attorney, Agent, or Firm*—Schwartz, Jeffery, Schwaab, Mack, Blumenthal & Evans

[57] ABSTRACT

Disclosed is an electrophotographic recording material comprising a photoconductive double layer disposed on an electrically conductive support, which double layer comprises a charge carrier-generating layer and a charge transport layer. The interface region of the charge carrier-generating and charge transport layers defines a mixing zone into which one or more of the constituents of the separate layers have diffused. A process for producing the electrophotographic recording material is also disclosed.

30 Claims, 4 Drawing Figures

ELECTROPHOTOGRAPHIC RECORDING MATERIAL HAVING A PHOTOCONDUCTIVE DOUBLE LAYER AND PROCESS FOR ITS MANUFACTURE

BACKGROUND OF THE INVENTION

The present invention relates to an electrophotographic recording material comprising an electrically conductive support, an optional insulating barrier layer, and a photoconductive double layer comprising a layer which generates charge carriers and a charge transport layer, which double layer contains an organic photoconductor, a binder, a dye, and, optionally, conventional additives. The present invention further relates to a process for the manufacture of the aforementioned electrophotographic recording material.

The use in electrophotographic recording materials of photoconductive layers which are composed of a photoconductor and a material acting as a binder is disclosed in U.S. Pat. No. 3,121,006. Binder layers are described which contain finely divided particles of a photoconductive inorganic compound, dispersed in an electrically insulating organic binder. The binder is a material which is incapable of transporting charge carriers generated by the photoconductor particles over a significant distance. Consequently, the photoconductive pigment particles within the layer must be in virtually continuous contact to enable the charges to be conducted away. Conductivity or charge transport is provided by a high concentration of the photoconductive pigment. With such a layer structure, a pigment concentration of more than 50 percent by weight is required.

It has also been disclosed (German Offenlegungsschrift No. 2,108,992, corresponding to U.S. Pat. No. 3,904,407) to produce photoconductive layers for electrophotographic recording materials in a double-layer arrangement. The disclosed material is composed of an electrically conductive support, a layer generating charge carriers, and a charge transport layer. The layer generating charge carriers can then comprise a dispersed pigment. If an insulating binder is used together with the dispersed pigment, a volume concentration of at least 25% of pigment is necessary. The ratio of the layer thicknesses of the charge transport layer and the layer generating charge carriers is 2:1 to 200:1.

It has also been disclosed (German Offenlegungsschrift No. 2,160,812, corresponding to U.S. Pat. No. 4,026,704) to provide photoconductive layers comprising a top layer and bottom layer, both of which contain a binder and the same organic photoconductor, the bottom layer additionally containing at least one activating sensitizer in a quantity of 1 to 20 percent by weight, relative to the total photoconductor content. The disclosed top layer comprises a binder and up to 50% by weight of photoconductor. The indicated layer thicknesses are 0.1 to 5 μm for the bottom layer and 5 to 20 μm for the top layer.

In order to improve the resolution of images obtained by an electrophotographic method, it has also been disclosed (U.S. Pat. No. 3,533,783) to use photoconductive layers which, in a bottom layer, contain an inorganic or organic photoconductor together with an activator, such as a pyrylium salt, and contain a photoconductor and binder in the top layer. The indicated thicknesses of the layers are generally 2.5 to 25 μm.

German Offenlegungsschrift No. 3,108,618 (corresponding to U.S. Pat. No. 4,340,658) describes a three-layer photoreceptor in which a pigment concentration of 50 to 95 percent by weight in the binder employed is necessary.

It has also been disclosed (German Pat. No. 1,117,391, corresponding to British Pat. No. 944,126) to use photoconductive, low-molecular organic compounds for the manufacture of printing plates by an electrophotographic method and to sensitize these compounds in the visible region of the spectrum by means of suitable dissolved dyes (corresponding to German Offenlegungsschrift No. 2,526,720, equivalent to U.S. Pat. No. 4,063,948). In place of the low-molecular substances, polymeric photoconductors together with an activator can also be used (German Offenlegungsschrift No. 2,726,116).

A disadvantage of the known electrophotographic recording materials with a binder, organic photoconductor and dye or pigment is their relatively unsatisfactory resolution, which manifests itself especially when a latent image charged at negative polarity is developed with a liquid developer. Individual lines of a line width below 60 μm then form an image of only reduced contrast, and lines of under 40 μm line width form no image at all. These resolution losses also occur in the case of correspondingly fine screen dots. A further disadvantage is the relatively high content of photoconductor. Thus, in order to obtain an adequate light sensitivity, the photoconductive layers must contain the organic photoconductor in a total concentration of 40 to 50 percent by weight, in addition to the insulating binder, and this manifests itself in considerably increased costs of the materials.

In the manufacture of printing forms by an electrophotographic method, it must also be considered that the organic photoconductors are insoluble in aqueous-alkaline decoating solutions. Decoating, such as is necessary in the case of use for printing plates and printed circuits, is therefore also impeded by these components. Moreover, the insoluble fractions deposit on rolls, pumps and other components in the decoating apparatus and cause increased maintenance costs.

Since, in the known double-layer materials, the transport layer with its large fraction of photoconductor is also thicker than the layer which generates charge carriers, the disadvantages described above also occur in such materials. Photoconductor double layers, for example, according to German Offenlegungsschrift No. 2,108,992, which are applied in 4 μm thickness to an aluminum support, give charge capacities which are inadequate for use in practice. Satisfactory results are obtained only with layer weights of more than 10 g/m$^2$, with considerable expense of material. A final disadvantage is that dye or pigment particles from the large fraction in the layer generating charge carriers, since they are in contact with the metallic substrate which is the support, become embedded in the pores of the surface, from which they are not removable later. Printing plates produced in this way scum on printing and are virtually useless.

SUMMARY OF THE INVENTION

It is therefore the object of the present invention to provide a high resolution electrophotographic recording material which has a high light sensitivity, coupled with the smallest possible fraction of organic photoconductor, and which is especially suitable for use in the production of printing plates or printed circuits, can readily be charged at low layer thicknesses and ensures a contrast-rich toner image.

It is a further object of the present invention to provide a photoconductor layer that can readily be decoated and that allows the production of printing plates or printed circuits even on metallic substrates, such as copper surfaces, which could hitherto be utilized only with technical difficulties.

It is yet another object of the present invention to provide a process for producing an electrophotographic recording material comprising a mixing zone, which particularly promotes generation of charge carriers, at the interface of the charge transport and charge carrier-generating layers of the recording material.

In accomplishing the foregoing objects, there has been provided, in accordance with the present invention, an electrophotographic recording material comprising an electrically conductive support and, disposed on the support, a photoconductive double layer which comprises a charge carrier-generating layer and a charge transport layer adjacent thereto, the charge carrier-generating layer comprising a first insulating binder which contains about 0.5 to about 20 weight-percent of dye material, relative to said charge carrier-generating layer, and the charge transport layer comprising a second insulating binder which contains (i) between about 25 and about 60 weight-percent of at least one photoconductor and (ii) not more than about 5 weight-percent of dye material, relative to the charge transport layer, wherein the interface region of the charge carrier generating layer and the charge transport layer defines a mixing zone into which at least one of the photoconductor and the dye material has diffused. In one preferred embodiment, the ratio of the thickness of the charge carrier-generating layer to the thickness of the charge transport layer is between about 3:1 to about 1:10.

In accordance with another aspect of the present invention, there has been provided a process for producing an electrophotographic recording material, comprising the steps of (A) applying to an electrically conductive support a first layer selected from the group consisting of (i) a charge carrier-generating layer comprising a first insulating binder which contains about 0.5 to about 20 weight-percent of dye material, relative to the charge carrier-generating layer, and (ii) a charge transport layer comprising a second insulating binder which contains (a) between about 25 and about 60 weight-percent of at least one photoconductor and (b) not more than about 5 weight-percent of the dye material, relative to the charge transport layer; and then (B) applying to the first layer a second layer selected from the group, the first and second layers being different, so that partial redissolution of the first layer occurs to form at the interface region of the first and second layers a mixing zone into which at least one of the photoconductor and the dye material has diffused. In a preferred embodiment, the second layer is subjected to drying carried out in at least a first stage and a second stage which differ in temperature, duration, or temperature and duration, both of the first and second stages having (i) a temperature ranging from about room temperature to about 130° C. and (ii) a duration between about 5 and about 30 seconds.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

The recording materials of the present invention can meet stringent demands and provide high resolution, while the photoconductor concentration, relative to the total layer, is kept relatively low. In the case of using the recording material according to the present invention for printing purposes, the high fraction of binder in the layer generating charge carriers ensures rapid decoating. At the same time, the low photoconductor fraction leads to improved technical feasibility of the process. Due to the use of relatively low dye concentrations in the layer generating charge carriers, the embedding of particles in the pores of the support surface is prevented. Even at low layer weights of the photoconductive double layer, the technically required charge values can be achieved with the recording material of the present invention. This is true even when materials, such as, copper, which hitherto presented considerable difficulties during charging, are used as a support.

Figure 1:
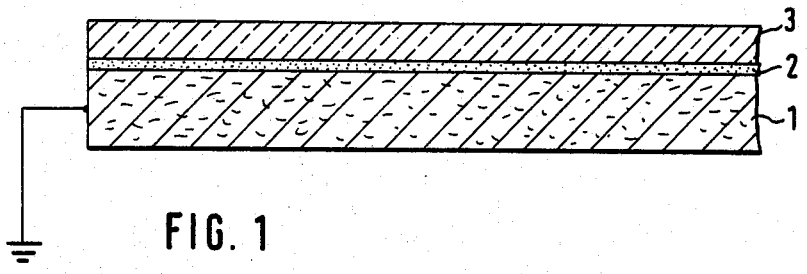
FIGS. 1 and 2 depict in schematic form two different electrophotographic recording materials within the present invention.
Figure 2:
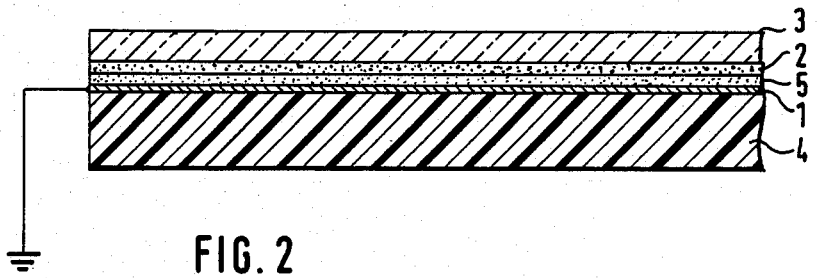

The structure of the electrophotographic recording material according to the present invention is shown diagrammatically in FIG. 1 and 2. FIG. 1 shows a material which is composed of an electrically conductive support 1, a layer 2 for generating charge carriers, and a charge transport layer 3. In FIG. 2, a metallized plastic film (1, 4) is provided as the support to which an insulating barrier layer 5 is applied. The photoconductive double layer is applied to barrier layer 5.

For the electrically conductive support 1 in FIG. 1, materials like those which have been used before for this purpose, having sufficient electrically conductive properties, are suitable. The support can be in the form of a drum, a flexible belt or a plate. In a preferred embodiment, the support is suitable for the production of printing forms and printed circuits and is comprised of, for example, an aluminum, zinc, magnesium, copper, iron, nickel, or multi-metal plate. Metallized plastic films, such as plastic films with vapor-deposited metal, for example, polyester films with vapor-deposited aluminum, and copper-laminated polyimide films and plates, can also be used.

Surface-modified supports of aluminum have proved particularly suitable. The surface modification comprises mechanical or electrochemical roughening and, if appropriate, subsequent anodizing and treatment with polyvinylphosphonic acid according to German Offenlegungsschrift No. 1,621,478, corresponding to U.S.

Pat. No. 4,153,461, the contents of which are incorporated herein by reference. The barrier layer thus obtained is denoted as layer 5 in FIG. 2. Generally, a thermally, anodically or chemically produced metal oxide layer, for example, of alumina, can be used as the barrier layer. The barrier layer has the object of reducing or preventing the injection of charge carriers from the electrically conductive support in the dark into the layer generating charge carriers. The barrier layer must not, however, impede charge flux during the exposure step. In addition, the barrier layer promotes adhesion of the subsequent layers to the support. Various natural or synthetic resin binders, which have good adhesion to a metal or aluminum surface and which do not undergo dissolution or detachment during subsequent application of additional layers, can be used for organic barrier layers. The thickness of the organic barrier layer is approximately 1 μm, and that of a metal oxide layer is on the order of 10 to $10^3$ nanometers.

For the production of, for example, printed circuits, such as are commonly used in electronics, the photoconductive doublelayer (2, 3) can also be applied initially to a temporary support (not shown), from which it is subsequently transferred as a so-called dry resist to the support 1 or (1, 4). This can be effected, for example, by lamination. Plastic films, such as those of polyester, particularly of polyethylene terephthalate, have proved particularly suitable as temporary supports.

The layer 2, as the layer generating charge carriers, contains at least one dye. The dye can be present in the layer either as a solution or as a dispersion in the binder. These known dyes which are suitable include, in particular, dyes from the group comprising perylene-3,4,9,10-tetracarboxylic acid derivatives according to German Pat. No. 2,237,539, corresponding to U.S. Pat. No. 3,871,882; metal-containing phthalocyanines according to, for example, German Offenlegungsschrift No. 3,245,637; perinones according to German Auslegeschrift No. 2,239,923, corresponding to British Pat. No. 1,416,603, and fused quinones, according to German Auslegeschrift No. 2,237,678, corresponding to U.S. Pat. No. 4,315,981. Soluble dyes which can be used include rhodamine dyes, cyanine dyes, and triarylmethane dyes.

Preferably, N,N'-dimethylperylene-3, 4, 9, 10-tetracarboxylic acid diimide (C.I. 71,130), copper-containing phthalocyanine (C.I. 74,160), Hostaperm Orange GR (C.I. 71,105), and/or Hostaperm Scarlet GO (C.I. 59,300) are used as the dye. Soluble dyes are preferably dyes such as Rhodamine B (C.I. 45,170), Astrazone Orange R (C.I. 48.040), and/or Brilliant Green (C.I. 42,040).

Suitable compounds for charge transport in the charge transport layer 3 are preferably those which possess an extensive $\pi$-electron system. These include monomeric heterocyclic compounds which are substituted by dialkyl-substituted amino groups or alkoxy groups. Heterocyclic compounds, such as oxadiazole derivatives mentioned in German Pat. No. 1,058,836, corresponding to U.S. Pat. No. 3,189,447 have proved particularly suitable. Triphenylamine derivatives, oxazole, pyrazoline, triazole and imidazole derivatives, such as are disclosed, for example, by German Pat. Nos. 1,120,875, 1,060,260, and 1,060,714 (corresponding to U.S. Pat. Nos. 3,257,203, 3,112,197, and 3,180,729, respectively) are also suitable. Hydrazone compounds, such as are mentioned, for example, in German Offenlegungsschrift No. 2,919,791 corresponding to U.S. Pat. No. 4,278,747, can also be employed. Preferably, 2,5-bis(4'dialkyl-aminophenyl)-1,3,4-oxadiazole, p-methoxybenzaldehyde diphenyl hydrazone and/or 1,5-diphenyl-3-p-methoxyphenyl pyrazoline are used.

The highly insulating binders for the layer generating charge carriers and for the charge transport layer, respectively, can be identical or different. With respect to flexibility, film properties and adhesive strength, natural and synthetic resins suitable as such binders are those which can be partially redissolved in or swollen by conventional solvents or solvent mixtures during the production of the layers. These include polyester resins which comprise mixed polyesters of isophthalic and terephthalic acid with glycols. Silicone resins have also proved to be suitable. Polycarbonate resins can readily be employed. Those binders are particularly preferred for the production of printing forms and printed circuits which are soluble in aqueous or alcoholic solvent systems, if appropriate with the addition of acid or alkali.

For physiological and safety reasons, aromatic or aliphatic, highly flammable solvents must be ruled out. Accordingly, suitable resin binders are high-molecular substances which carry side groups conferring solubility in alkali. Examples of such groups are acid anhydride groups, carboxyl groups, carboxylic acid amide groups, phenol groups, sulfonic acid groups, sulfonamide groups or sulfonimide groups.

Preferably, resin binders with high acid numbers are employed. Copolymers with anhydride groups can be used very successfully, since their conductivity in the dark is low due to the absence of free acid groups, despite good solubility in alkali. Copolymers of styrene and maleic anhydride, sulfonylurethanes according to German Offenlegungsschrift No. 32 10 577, and copolymers of acrylic or methacrylic acid have proved particularly suitable.

As conventional additives, the layers contain substances which are added to the coating solution to improve the surface structure and the flexibility. For example, these additives can be plasticizers, such as triphenyl phosphate, or levelling agents, such as silicone oils.

In the interface region between the charge carrier generating layer and the charge transport layer, there is a zone where substances from both layers are mixed. This zone is obtained essentially as a result of layer constituents, in particular photoconductors, passing by diffusion during the application of the second layer into the first-applied layer. The thickness of the mixing zone is between about 1.5 and about 2 μm. To avoid so-called "poisoning" phenomena on metallic substrates like, p.e., copper or iron, the thickness of the charge carrier generating layer 2 must exceed the thickness of the mixing zone. From the appearance of these "poisoning" phenomena caused by an interaction of the metallic surface and the photoconductor—at a thickness of layer 2 of about 2 μm—a thickness of the mixing zones within a range of about 1.5–2 μm can be assumed by analogy.

The total layer thicknesses of the photoconductive double layer are in the range between about 5 and about 25 μm. In the case of use for printing plates, the total layer thickness is preferably in the range from about 4 to about 10 μm. In the case of use for printed circuits, the total layer thicknesses are in the range of from about 6 to about 50 μm.

The present invention also relates to a process for producing the above-described electrophotographic recording material, in which process the photoconductive double layer is applied to the electrically conductive support. The process comprises applying the first coating solution or dispersion and drying the coating, at least to the point of solidifying it, and then coating the second coating solution or dispersion on top of the first, and thereafter drying the second coating, with the result of partially redissolving or swelling the first layer. Advantageously, the coating solution or dispersion of the layer generating charge carriers is applied and dried, at least to the point of solidifying, and the coating solution or dispersion of the charge transport layer is then coated on top and dried, with partial redissolution of the preceding layer. Preferably, the drying of the double layer is carried out in stages with respect to duration and temperature. The duration of the individual stages is within the range from about 10 seconds to a few minutes. The drying temperature is in the range from room temperature up to about 130° C. A process within the present invention which proved particularly advantageous comprises drying of the applied solutions or dispersions in stages, at temperatures in the range from room temperature to 130° C. and for periods from 5 to 30 seconds.

As a result of the process of the present invention, within the interface region of the surfaces of the layer generating charge carriers and the charge transport layer, respectively, a mixing zone of the constituent substances is obtained, having a thickness of about 1.5 to about 2 μm, which zone particularly promotes the generation of charge carriers.

The solvents or solvent mixtures used for the coating solution have boiling points which allow drying within the conventional industrial range, have good solution properties for photoconductors and binders, and do not pollute the environment. These include lower alcohols, lower ketones and ethers, and esters. Examples of suitable solvents include tetrahydrofuran, acetone, methylglycol and butyl acetate. It has been found that quickly drying coating solutions or dispersions advantageously contain tetrahydrofuran as the solvent.

During the drying process, according to the invention, the step of partially redissolving the layer first applied takes place initially at a relatively low temperature. Subsequently, drying takes place, preferably in a stepwise fashion, in the temperature range from about 80° to about 120° C.

The coatings are applied in the conventional manner, for example, by blade application or by spraying. Preferably, application is effected with a flow-coater. Drying of the layers is carried out, for example, in drying tunnels, the various drying stages being fixed by the temperature of the individual zones, by the running speed of the material, and by the air rate used.

The invention is explained in more detail by reference to the following examples and comparison examples.

EXAMPLE 1

The following dispersion was applied to a support having a barrier layer, such as an electrochemically pretreated and anodized aluminum support, used as a carrier for an offset printing plate, in such a way that a dry layer weight of 3 g/m² was obtained:

50 g of a copolymer of styrene and maleic anhydride, (decomposition point 200° and 240° C.) were dissolved in
950 g of tetrahydrofuran with the addition of
0.1 g of silicone oil of viscosity 5 to 20 mPa . s
2 g of N,N'-dimethylperylene-3,4,9,10-tetracarbox ylic acid diimide (C.I. 71,130) were dispersed in the solution within 2 hours by grinding in a ball mill.

The resulting layer was dried.

A charge transport layer was then applied from the following solution to the above-mentioned charge carrier-generating layer:

50 g of a copolymer of styrene and maleic anhydride and
50 g of 2,5-bis-(4'-diethylaminophenyl)-1,3,4-oxadiazole were dissolved in
700 g of tetrahydrofuran and
250 g of butyl acetate, with the addition of
0.1 g of silicone oil.

The liquid top layer was dried for about 10 seconds at room temperature, then for 30 seconds at 60° C. and subsequently for about 120 seconds at 110° C. Under these conditions, partial redissolution of the charge carrier generating layer and a defined mixing zone were both obtained. Application of the charge transport layer was adjusted so that the total layer weight was 6 g/m², corresponding approximately to a thickness of 6 μm.

Figure 3:
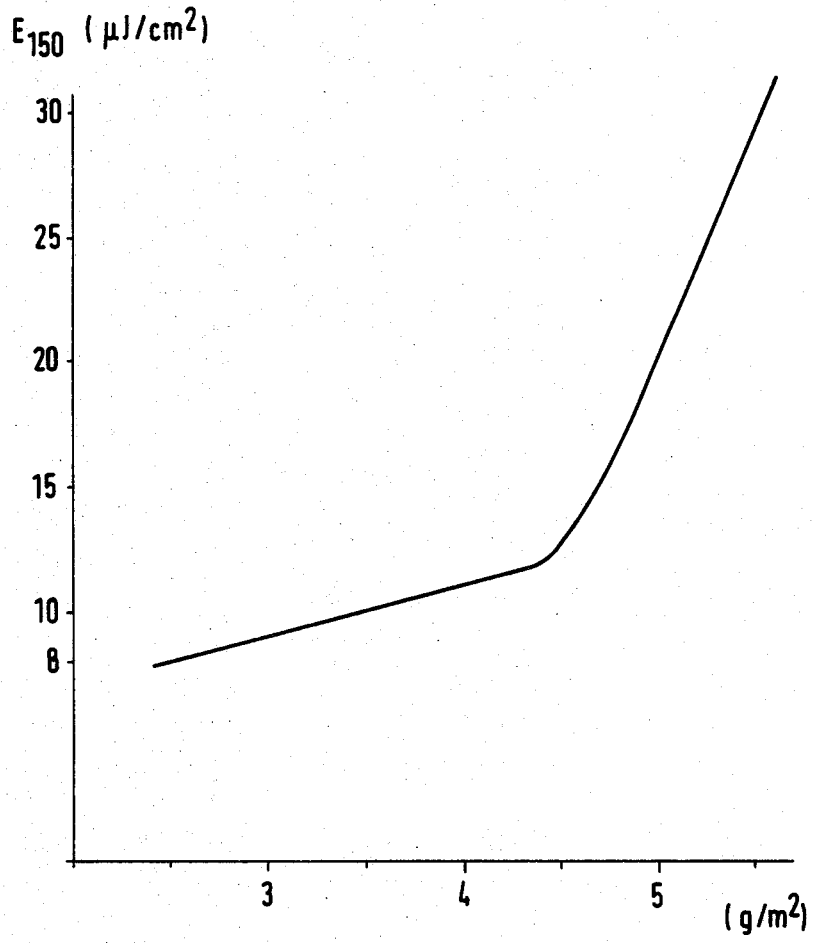
FIG. 3 shows a graph in which the sensitivity of an electrophotographic recording material within the present invention is plotted as a function of the weight of the charge carrier-generating layer.

The coating procedure was repeated, with the total layer weight of 6 g/m² remaining the same, but with the layer thickness of the layer generating charge carriers varying between 0.5 and 5.5 g/m², at constant pigment content. The corresponding ratio of thicknesses of the layer generating charge carriers to the charge transport layer was in the range of about 10:1 to about 1:10. Dependence of the recording material's sensitivity on the thickness of the layer which generates charge carriers is shown in FIG. 3, where the energy required for discharge to 150 V ($E_{150}$) is plotted as a function of the layer weight of the charge carrier-generating layer, with an overall layer weight of 6 g/m². From FIG. 3, it is evident that good results were obtained for thickness ratios in the range from about 3:1 to about 1:10.

In spite of their low content of organic photoconductor (transport compound), the layers prepared in accordance with the present invention were distinguished by a high sensitivity in negative charging of the layer and by very good resolution. Demonstrative data concerning sensitivity and resolution are presented in the Table 1, where the $E_{\frac{1}{2}}$ values (discharge to half the original charge) relate to exposure with halide lamps through heat protection filters.

In a printing test, the printing plate obtained after the steps of imaging, developing with a commercially available liquid developer, fixing, and decoating in accordance with German Auslegeschrift No. 1,117,391 gave a run of far more than 100,000 prints, with good halftone reproduction; the 20 μm lines in the K field of the PMS wedge were reproduced.

EXAMPLE 2 (COMPARISON EXAMPLE)

2 g of N,N'-dimethylperylene-3,4,9,10-tetracarboxylic acid diimide were dispersed by grinding for 2 hours in a ball mill in a solution of
75 g of the copolymer of styrene and maleic anhydride from Example 1 and
25 g of 2,5-bis-(4'-diethylamino-phenyl)-1,3,4-oxadiazole, in
900 g of tetrahydrofuran, with the addition of
0.1 g of silicone oil.

The dispersion was applied to a printing plate support according to Example 1 in such a way that, after drying, a layer weight of 6 g/m² was obtained. The composition of the layer corresponded to the combination of 3 g/m² of the layer generating charge carriers and 3 g/m² of the charge transport layer from Example 1. The light sensitivity (E) was markedly reduced as compared with the layer from Example 1, and the resolution of the images produced on this material is markedly poorer than that on the material according to Example 1. In the K field of the PMS wedge, no reproduction of the 40 μm lines was obtained.

TABLE 1

| Example (No.) | With charging to (V) | $E_{\frac{1}{2}}$ (μJ/cm²) |
|---|---|---|
| 1 | −400 | 5.5 |
| 2 (comparison) | −400 | 7.9 |
| 5 | −400 | 5.4 |
| 6 | +650 | 5.0 |
| 7 (comparison) | +500 | 10.3 |
| 8 | −450 | 5.4 |
| 9 (comparison) | −450 | 6.7 |
| 10 | −400 | 6.1 |
| 11 | −600 | 5.0 |
| 12 | −600 | 5.6 |
| 13 | −550 | 9.6 |
| 14 (comparison) | −550 | 9.3 |

EXAMPLE 3

The coatings of Example 1 were repeated, with the difference that, instead of the printing plate support mentioned there, a copper-laminated polyimide sheet was employed, of the kind used for the production of flexible printed circuit boards in electronics.

In this case, it was not possible to charge the double layers with 0.5, 1.0 or 1.5 g/m² of layer generating charge carriers, respectively, to more than −500 V. These layers were therefore unsuitable for use in practice. The coatings with layers in the range from 2 g/m² to 4.5 g/m², however, gave charges of more than −500 V. It was then possible to obtain toner images with high resolution after charging, exposure and developing with a liquid developer. These sheets could then be processed by decoating and removal of the metallic non-image areas by etching, to give high-grade flexible printed circuit boards.

A ratio of the thicknesses for the layer generating charge carriers over the charge transport layer of between about 2:1 and about 1:3 was particularly advantageous for industrial applications.

EXAMPLE 4 (COMPARISON EXAMPLE)

The coating of Example 2 was repeated, but with the difference that, in place of an aluminum printing plate support, a copper-laminated polyimide sheet according to Example 3 was used.

The electrophotographic recording material thus produced could be charged only to less than −100 V and was therefore unsuitable for use in practice. It is presumed that "poisoning" occurred on contact of the photoconductor solution with a copper surface. The problem of the lack of chargeability of thin layers (6 g/m²) also arose in the coating with solutions of other photoconductors, such as oxazole, pyrazoline and hydrazone compounds, on copper-containing materials. A similar loss of chargeability, though less pronounced, was also obtained in the case of coating of iron- and nickel-containing materials respectively. It was discovered that this charging loss could be avoided by introducing a photoconductor-free, charge carrier-generating layer in contact with appropriate metal surfaces.

The results of Example 3 show that, with the process of the present invention, including the partial redissolution of the layer generating charge carriers, a mixing zone of about 1.5 to 2 μm thickness is produced between the two layers.

EXAMPLE 5

2 g of N,N'-dimethylperylene-3,4,9,10-tetracarboxylic acid diimide were dispersed within 2 hours by grinding in a ball mill in a solution of
50 g of a sulfonylurethane (prepared by reacting a polyvinyl butyral with a quantity, equimolar with respect to free OH groups, of propenylsulfonyl isocyanate, as described in German Offenlegungsschrift No. 32 10 577, Example 1), and
950 g of tetrahydrofuran, with the addition of
0.1 g of silicone oil.

The solution was applied to an aluminum printing plate support. The application of the solution was controlled in such a way that a dry layer weight of 3 g/m² resulted. The following solution of a charge transport layer was applied (wet-on-wet coating) to the still-wet layer for generating charge carriers:

50 g of the sulfonylurethane described and
50 g of 2,5-bis-(4'-dimethylaminophenyl)-1,3,4-oxadiazole were dissolved in
900 g of tetrahydrofuran, with the addition of
0.1 g of silicone oil.

This layer was dried for about 30 seconds at 60° C. and then for about 120 seconds at 100° C. Under these conditions, a defined mixing zone between the two layers was obtained. The dry layer weight of this double-layer recording material was 6 g/m².

EXAMPLE 6

Figure 4:
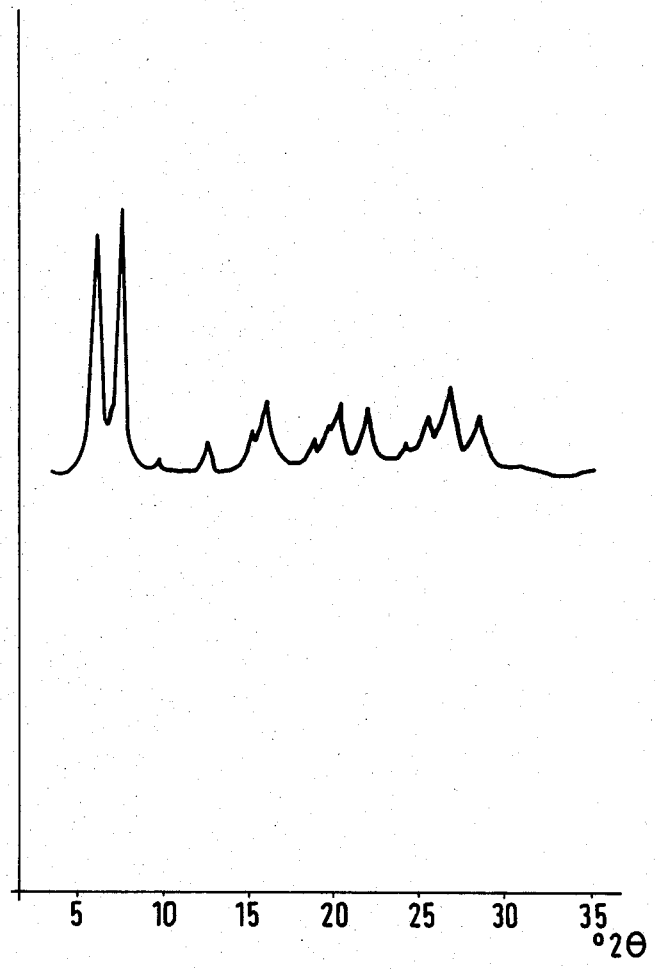
FIG. 4 shows the X-ray diffraction spectrum of a preferred constituent compound for the charge carrier-generating layer of an electrophotographic recording material within the present invention.

3 g of N,N'-dimethylperylene-3,4,9,10-tetracarboxylic acid diimide and
1 g of ε-copper phthalocyanine (Lionol Blue ERPC from Toyo Ink Manufacturing Co., Japan; its X-ray diffraction spectrum is shown in FIG. 4) were dispersed within 2 hours by grinding in a ball mill in a solution of
100 g of a sulfonylurethane in
900 g of tetrahydrofuran, with the addition of
0.1 g of silicone oil.

The dispersion was coated on a polyester film as a temporary support. The coating was dried. This gave a dry layer weight of 3 g/m². The following solution of a charge transport layer was applied to this layer for generating charge carriers:

50 g of a sulfonylurethane and
50 g of 2,5-bis-(4'-dimethylaminophenyl)-1, 3, 4-oxadiazole were dissolved in
700 g of tetrahydrofuran and
200 g of butyl acetate, with the addition of
0.1 g of silicone oil.

This layer was dried for about 30 seconds at 60° C. and then for about 120 seconds at 100° C.

Under these conditions, a defined mixing zone between the two layers was obtained.

The dry layer weight of this double layer material on the temporary support was 6 g/m$^2$.

Subsequently, the double layer was transferred in a laminator at 120° C. to a bright aluminum foil. The electrophotographic recording material produced in this way had a high charge acceptance (see Table 1) and excellent spectral sensitivity in the range from 400 to 800 nm with positive charging.

EXAMPLE 7 (COMPARISON EXAMPLE)

The procedure used in Example 6 was followed, with the differences, (1) that the order of the coatings was reversed and carried out without partial redissolution of the first-applied layer and (2) that the coating was made directly on an aluminum foil. The material thus obtained therefore corresponded in its layer structure-aluminum support charge transport layer with binder/-photoconductor, and binder/pigment layer generating charge carriers- to the material of Example 6.

This material had not even half the sensitivity of the material of the present invention, exemplified in Example 6. It is presumed that this difference in sensitivity is attributable to the unduly restricted foCrmation of a mixing zone between the layers. Whereas the diffusible photoconductor is already present in solution in Example 6 and can, therefore, readily penetrate into the partially swollen or redissolved existing layer, in this Example additionally the dissolution of the photoconductor of the first layer is necessary prior to its diffusion, which apparently is impossible within a feasible period of time.

EXAMPLE 8

The procedure used in Example 1 was followed, with the differences (1) that, instead of 4% of N,N'-dimethylperylene-3,4,9,10-tetracarboxylic acid diimide, 5% of Hostaperm Orange GR (C.I. 71,105) was used; (2) that the layer weight of the layer generating charge carriers was 1.5 g/m$^2$; and (3) that the layer weight of the charge transport layer was 4.5 g/m$^2$.

EXAMPLE 9

The procedure followed was as in Example 8, with the sole difference that, in the layer generating charge carriers, a mixture of 80% of the binder and 20% of 2,5-bis-(4'-dimethylaminophenyl)-1,3,4-oxadiazole was used in place of the binder of Example 8. This layer arrangement corresponds to the recording material described in German Offenlegungsschrift No. 2,160,812. The data in Table 1 show that the addition of the photoconductor leads to a slight reduction in sensitivity, with a simultaneous, marked lowering of the decoating rate.

EXAMPLE 10

The procedure used in Example 1 was followed, with the difference that, in place of N,N'-dimethylperylene-3,4,9,10-tetracarboxylic acid diimide, Hostaperm Scarlet GO (C.I. 59,300) was used. The binder employed was a copolymer of styrene, methacrylic acid and hexyl methacrylate, in a monomer ratio of 10:30:60.

EXAMPLE 11

The procedure followed was as in Example 1, with the difference that, instead of 2,5-bis-(4'-dimethylaminophenyl)-1,3,4-oxadiazole, 1,5-diphenyl-3-p-methoxyphenyl-pyrazoline was used analogously to German Auslegeschrift No. 1,060,714.

EXAMPLE 12

The procedure followed was as in Example 1, with the difference that, in place of 2,5-bis-(4'-dimethylaminophenyl)-1,3,4,-oxadiazole, p-methoxy-benzaldehyde diphenylhydrazone according to German Offenlegungsschrift No. 2,919,791 was used.

The charging and sensitivity of the recording materials described in Example 8, 9, 10, 11 and 12 are shown in Table 1.

EXAMPLE 13

An electrochemically roughened and anodized aluminum support, such as is used as a support with a barrier layer for offset printing plates, was coated with the following solution:

50 g of a sulfonylurethane were dissolved in
950 g of tetrahydrofuran, with the addition of
0.1 g of silicone oil as well as
1 g of Rhodamine B (C.I. 45, 170) dissolved in 1
0 g of methanol.

The coating was dried, and it had a dry layer weight of 3 g/m$^2$.

The following solution of a charge transport layer was applied to this layer:

50 g of a sulfonylurethane and
50 g of 2,5-bis-(4'-dimethylaminophenyl)-1,3,4-oxadiazole, dissolved in
900 g of tetrahydrofuran with the addition of
0.1 g of silicone oil as well as
0.1 g of Rhodamine B (C.I. 45, 170) dissolved in
1 g of methanol.

Drying was carried out as described in Example 1. The dry layer weight of this double layer was about 6 g/m$^2$. The recording material thus prepared could be charged to −800 V, showed good sensitivity and, after charging, imagewise exposure, development with a liquid developer and decoating, yielded printing plates of high resolution.

EXAMPLE 14 (COMPARISON EXAMPLE)

As in Example 13, a printing plate support was coated with a solution of 50 g of a sulfonylurethane and
50 g of 2,5-bis-(4'-dimethylaminophenyl)-1,3,4-oxadiazole, dissolved in
900 g of tetrahydrofuran with the addition of
0.1 g of silicone oil as well as
0.5 g of Rhodamine B (C.I. 45,170) dissolved in
5 g of methanol, and was dried.

The dry layer weight was about 6 g/m$^2$.

In spite of twice the photoconductor content in the total layer, as compared with Example 13, the recording material thus prepared showed only comparable sensitivity to the recording material of Example 13.

When the plate described above was treated with an aqueous-alkaline decoater according to German Auslegeschrift No. 1,117,391 in a commercial decoater apparatus, the layer could be removed only slowly, due to its high content of insoluble photoconductor. The plate throughput was low. In contrast, due to its lower content of photoconductor, the Example 13 recording material of the present invention could be decoated three times faster.

EXAMPLE 15 (COMPARISON EXAMPLE)

Similarly to Example 13, a recording material comprising a layer (1.5 g/m$^2$) for generating charge carriers, said layer composed of 38% of 2,5-bis-(4'-dimethylaminophenyl)-1,3,4-oxadiazole, 57% of a copolymer of styrene and maleic anhydride and 5% of Rhodamine B, and a charge transport layer (10 g/m$^2$), composed of 50% of 2,5-bis-(4'-dimethylaminophenyl)-1,3,4-oxadiazole and 50% of a copolymer of styrene and maleic anhydride, was prepared. The resulting material substantially corresponded to that described in German Offenlegungsschrift No. 2,160,812, Example 3. Under the measurement conditions (halogen lamp with heat protection filters) used in all the above examples, the double layer had a sensitivity $(E_{\frac{1}{2}})^{-1}$ of $(79\ \mu l/cm^2)^{-1}$.

What is claimed is:

1. An electrophotographic recording material comprising an electrically conductive support and, disposed on said support, a photoconductive double layer which comprises a charge carrier-generating layer and a charge transport layer adjacent to said charge carrier-generating layer, (A) said charge carrier-generating layer consisting essentially of a first insulating binder which contains about 0.5 to about 20 weight-percent of dye material, relative to said charge carrier-generating layer, and (B) said charge transport layer comprising a second insulating binder which contains (i) between about 25 and about 60 weight-percent of at least one photoconductor and (ii) not more than about 5 weight-percent of said dye material, relative to said charge transport layer, said first and second insulating binders being indentical, wherein the interface region of said charge carrier-generating layer and said charge transport layer defines a mixing zone having a thickness of between about 1.5 and about 2 μm, and into which at least one of said photoconductor and said dye material has diffused, said mixing zone being the product of a process comprising the steps of (1) applying a first layer selected from the group consisting of said charge carrier-generating layer and said charge transport layer to said support and (2) applying to said first layer a second layer selected from said group, said first and second layers being different, so that partial redissolution of said first layer occurs to form said mixing zone, into which at least one of said photoconductor and said dye material diffuses.

2. An electrophotographic recording material as claimed in claim 1, wherein the ratio of the thickness of said charge carrier-generating layer to the thickness of said charge transport layer is between about 3:1 to about 1:10.

3. An electrophotgraphic recording material as claimed in claim 1, further comprising an insulating barrier layer interposed between said support and said photoconductive double layer.

4. An electrophotographic recording material as claimed in claim 1, wherein said dye material is dissolved or dispersed in said photoconductive double layer.

5. The electrophotographic recording material as claimed in claim 1, wherein at least one of said first and second insulating binders comprises a high-molecular substance which contains side groups conferring solubility in alkali.

6. A recording material as in claim 1, wherein both said dye and said photoconductor have diffused into said mixing zone.

7. The electrophotographic recording material as claimed in claim 1, wherein said photoconductive double layer was transferred from a temporary support to said support.

8. An electrophotographic recording material as claimed in claim 7, wherein said support was provided with an insulating barrier layer before transfer of said photoconductive double layer from said temporary support.

9. The recording material as claimed in claim 1, wherein said dye material comprises at least one selected from the group consisting of a perylene-3,4,9,10-tetracarboxylic acid derivative, a metal-containing phthalocyanine, a perinone, a fused quinone, a rhodamine dye, a cyanine dye, and a triarylmethane dye.

10. The recording material as claimed in claim 9, wherein said dye material comprises at least one selected from the group consisting of N,N'-dimethylperylene-3,4,9,10-tetracarboxylic acid diimide (C.I. 71,130), a metal-containing phthalocyanine (C.I. 74,160), Hostaperm Orange GR (C.I. 71,105), and Hostaperm Scarlet GO (C.I. 59,300).

11. The recording material as claimed in claim 9, wherein said dye material comprises at least one selected from the group consisting of Rhodamine B (C.I. 45,170), Astrazone Orange R (C.I. 48,040), and Brilliant Green (C.I. 42,040).

12. The recording material as claimed in claim 1, wherein said support comprises a metal plate or a metallized plastic film.

13. The recording material as claimed in claim 12, wherein said support comprises an aluminum plate which has been electrochemically roughened and anodized.

14. The recording material as claimed in claim 12, wherein said support comprises a copper-laminated polyimide film.

15. The recording material as claimed in claim 1, wherein said photoconductor is at least one selected from the group consisting of an oxadiazole, an oxazole, a pyrazoline, a triazole, a imidazole, and a hydrazone.

16. The recording material as claimed in claim 15, wherein said photoconductor comprises 2,5-bis-(4'-dialkylaminophenyl)-1,3,4-oxadiazole.

17. The recording material as claimed in claim 15, wherein said photoconductor comprises p-methoxybenzaldehyde diphenylhydrazone.

18. The recording material as claimed in claim 15, wherein said photoconductor comprises 1,5-diphenyl-3-p-methoxy-phenyl-pyrazoline.

19. The recording material as claimed in claim 2, wherein said ratio is between about 2:1 and about 1:3.

20. The recording material as claimed in claim 5, wherein at least one of said first and second insulating binders comprises at least one from the group consisting of a copolymer of styrene and maleic anhydride, a sulfonylurethane, and a compolymer of acrylic acid and/or methacrylic acid.

21. A process for producing an electrophotographic recording material, comprising the steps of (A) applying to an electrically conductive support a first layer selected from the group consisting of (i) a charge carrier-generating layer comprising a first insulating binder which contains about 0.5 to about 20 weight-percent of dye material, relative to said charge carrier-generating layer, and (ii) a charge transport layer comprising a second insulating binder which contains (a) between about 25 and about 60 wieght-percent of at least one photoconductor and (b) not more than about 5 weight-percent of the dye material, relative to the charge transport layer, said first and second insulating binders being identical; and then (B) applying to said first layer a second layer selected from said group, said first and second layers being different, so thtat partial redissolution of said first layer occurs to form at the interface region of said first and second layers a mixing zone having a thickness of between about 1.5 and about 2 μm, and into which at least one of said photconductor and said dye material has diffused.

22. A process as claimed in claim 21, wherein said first layer is said charge carrier-generating layer and said second layer is said charge transport layer.

23. A process as claimed in claim 21, wherein step (B) comprises drying said second layer to solidity in a stepwise fashion.

24. A process as claimed in claim 23, wherein said drying is carried out in at least a first stage and a second stage which differ in temperature, duration, or temperature and duration, both of said first and second stages having (i) a temperature ranging from about room temperature to about 130° C. and (ii) a duration between about 5 and about 30 seconds.

25. A recirding material as in claim 1, wherein said sharge carrier-generating layer is photoconductor-free.

26. A recording material as in claim 1, wherein said substrate comprises a copper surface to which said first layer is applied.

27. A recording material as in claim 1, wherein said substrate comprises an iron- or nickel-containing material.

28. A recording material as in claim 1, wherein said step (2) of applying said second layer to said first layer comprises drying said second layer to solidity in a stepwise fashion.

29. A recording material as in claim 28, wherein said drying is carried out in at least a first stage and a second stage which differ in temperature, duration, or temperature and duration, both of said first and second stages having (i) a temperature ranging from about room temperature to about 130° and (ii) a duration between about 5 and about 30 seconds.

30. A process as in claim 21, wherein step (B) comprises diffusion of both said dye and said photoconductor into said mixing zone.

* * * * *